United States Patent [19]

Noguchi et al.

[11] 4,216,747

[45] Aug. 12, 1980

[54] UNIFLOW, DOUBLE-OPPOSED PISTON TYPE TWO-CYCLE INTERNAL COMBUSTION ENGINE

[75] Inventors: Masaaki Noguchi, Nagoya; Yukiyasu Tanaka, Okazaki; Taro Tanaka; Norikatsu Uejima, both of Chiryu, all of Japan

[73] Assignee: Nippon Soken, Inc., Nishio, Japan

[21] Appl. No.: 939,774

[22] Filed: Sep. 5, 1978

[30] Foreign Application Priority Data

Sep. 7, 1977 [JP] Japan ..... 52-107383
Sep. 16, 1977 [JP] Japan ..... 52-111978

[51] Int. Cl.[2] ..... F02B 25/10

[52] U.S. Cl. ..... 123/51 BA; 123/443; 123/51 BD; 123/73 A

[58] Field of Search ..... 123/DIG. 4, 51 R, 51 B, 123/51 BA, 51 BD, 32 ST, 75 B, 73 A, 73 R, 53 R, 53 B, 53 BA

[56] References Cited

U.S. PATENT DOCUMENTS

| | | | |
|---|---|---|---|
| 871,539 | 11/1907 | Auken | 123/51 BA |
| 1,978,194 | 10/1934 | Gray | 123/51 BA |
| 2,345,056 | 3/1944 | Mallory | 123/51 BA |
| 2,393,342 | 1/1946 | Schneider | 123/65 A |
| 2,844,131 | 7/1958 | Beveridge | 123/51 BA |
| 3,923,019 | 12/1975 | Yamada | 123/32 ST |
| 4,071,000 | 1/1978 | Herbert | 123/51 BA |

FOREIGN PATENT DOCUMENTS 467513 6/1914 France ..... 123/51 BD

*Primary Examiner*—Charles J. Myhre
*Assistant Examiner*—Craig R. Feinberg
*Attorney, Agent, or Firm*—Cushman, Darby & Cushman

[57] ABSTRACT

In a uniflow, double-opposed piston type two-cycle internal combustion engine of the type having first and second crank chambers attached to the ends of a cylinder, first and second pistons disposed in the first and second crank chambers, respectively, and slidably fitted into the cylinder so as to move toward and away from each other, an exhaust port formed through the cylinder wall and opened and closed by the first piston, and a plurality of scavenging ports formed through the cylinder wall and opened and closed by the second piston, an improvement comprising means for feeding the rich air-fuel mixture to some of the scavenging ports, means for feeding the lean air-fuel mixture or the air to the remaining scavenging ports, and the lean mixture or air scavenging ports being uncovered and opened earlier than the rich mixture scavenging ports, whereby the scavenging efficiency may be improved and the amount of air-fuel mixture escaping through the exhaust port together with the combustion products may be minimized. In addition, the first piston is advanced in phase by a predetermined degree over the second piston so that the compression ratio may be increased and consequently the engine output may be increased.

3 Claims, 5 Drawing Figures

UNIFLOW, DOUBLE-OPPOSED PISTON TYPE TWO-CYCLE INTERNAL COMBUSTION ENGINE

BACKGROUND OF THE INVENTION

The present invention relates to a uniflow, double-opposed piston type two-cycle internal combustion engine and more particularly to an improvement thereof in order to improve the scavenging efficiency and to minimize the escaping of air-fuel mixture through an exhaust port together with the remaining combustion products.

In general, in the uniflow type two-cycle engines, the charged air-fuel mixture is made to flow along the axis of the cylinder in one direction so that they may attain the scavenging efficiency higher than the Schnurle type engines and the amount of the air-fuel mixture escaping through the exhaust port together with the remaining combustion products is less. However, their performance is still unsatisfactory in practice and a further improvement has been desired.

SUMMARY OF THE INVENTION

Accordingly, one of the objects of the present invention is to provide a uniflow, double-opposed piston type two-cycle internal combustion engine wherein the remaining combustion products may be almost completely expelled out of the cylinder by the charging of the air or the lean air-fuel mixture and then the rich air-fuel mixture is charged into the cylinder, whereby the scavenging efficiency may be improved and the amount of the air-fuel mixture escaping through the exhaust port together with the remaining combustion products may be minimized.

Another object of the present invention is to provide a uniflow, double-opposed piston type two-cycle internal combustion engine wherein one of the two pistons is advanced in phase by a predetermined degree over the other piston, whereby the charging of the air or the air-fuel mixture into the cylinder may be much enhanced, and at the same time the compression ratio may be improved and consequently the engine output may be increased.

To the above and other ends, the present invention provide a uniflow, double-opposed piston type two-cycle internal combustion engine of the type having a cylinder, a pair of crankcases securely attached to the ends of said cylinder so as to define a first crank chamber and a second crank chamber, a pair of cranks disposed in said first and second crank chambers, respectively, first and second pistons operatively connected to said cranks, respectively, and slidably fitted into said cylinder so as to move toward and away from each other, an exhaust port being formed through the cylinder wall so as to be opened and closed by said first piston, and a plurality of scavenging ports being formed through the cylinder wall so as to be opened and closed by said second piston, characterized by the provision of means for feeding the rich air-fuel mixture to some of said plurality of scavenging ports, and means for feeding the lean air-fuel mixture or air to the remaining scavenging ports, said rich air-fuel mixture feeding means and said lean air-fuel mixture or air feeding means being so arranged that said lean mixture or air scavenging ports or said remaining scavenging ports may be opened earlier than said rich mixture scavenging ports or said some scavenging ports.

According to the present invention, the lean mixture or air scavenging ports are uncovered and opened earlier than the rich mixture scavenging ports so that the scavenging efficiency may be considerably improved and the amount of air-fuel mixture eacaping through the exhaust port together with the remaining combustion products may be minimized.

According to one aspect of the present invention, the first piston which opens and closes the exhaust port is advanced in phase by a predetermined degree over the second piston which opens and closes the scavenging ports so that the volume of the air-fuel mixture sucked into the cylinder is increased as compared with the engines wherein both the first and second pistons are in the same phase. On the other hand, the distance between the heads of the first and second pistons when they are at or closer to the top dead center is slightly increased as compared with the two-cycle engines where the first and second engines are in the same phase. As a consequence the compression ratio may be improved and consequently the engine output may be remakably increased. In case of the two-cycle engines where the first and second pistons are in the same phase, the scavenging ports are uncovered and opened immediately after the exhaust ports have been uncovered and opened so that the pressure in the cylinder rises and consequently the suction of the air-fuel mixture or air is adversely affected. However, according to the present invention, the exhaust port is wide opened when the air-fuel mixture or air is drawn into the cylinder so that the pressure in the cylinder approaches the atmospheric pressure so that the suction may be much enhanced.

BRIEF DESCRIPTION OF THE DRAWINGS

Same reference numerals are used to designate similar members or parts throughout the figures.

DESCRIPTION OF THE PREFERRED EMBODIMENTS

Figure 1:
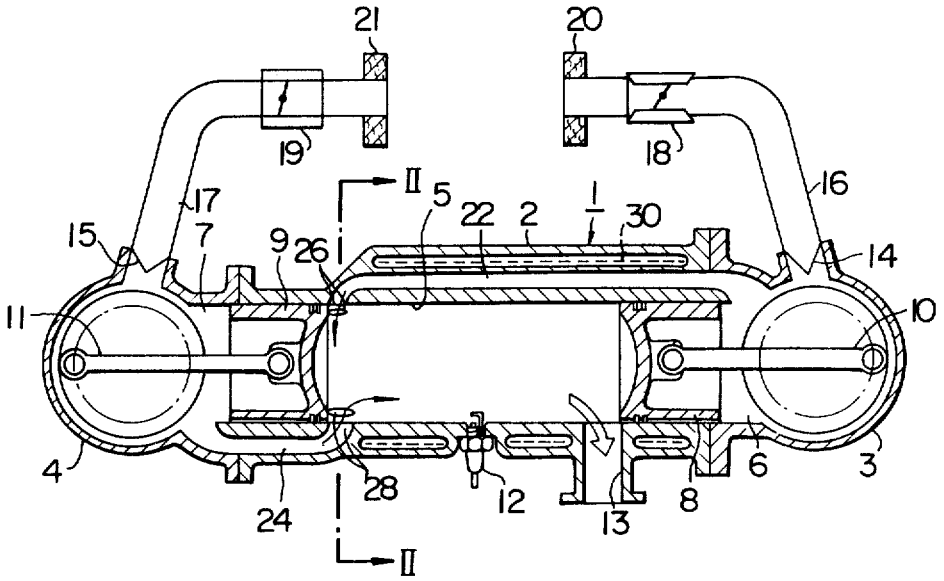
FIG. 1 is a longitudinal sectional view, taken along the line I—I of FIG. 2 and viewed in the direction of the arrows, of a first embodiment of a uniflow, double-opposed piston type two-cycle internal combustion engine in accordance with the present invention.
Figure 2:
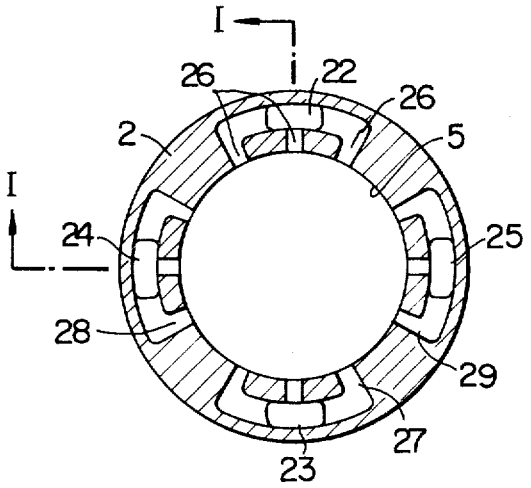
FIG. 2 is a sectional view thereof taken along the line II—II of FIG. 1 and viewed in the direction indicated by the arrows.
Figure 3:
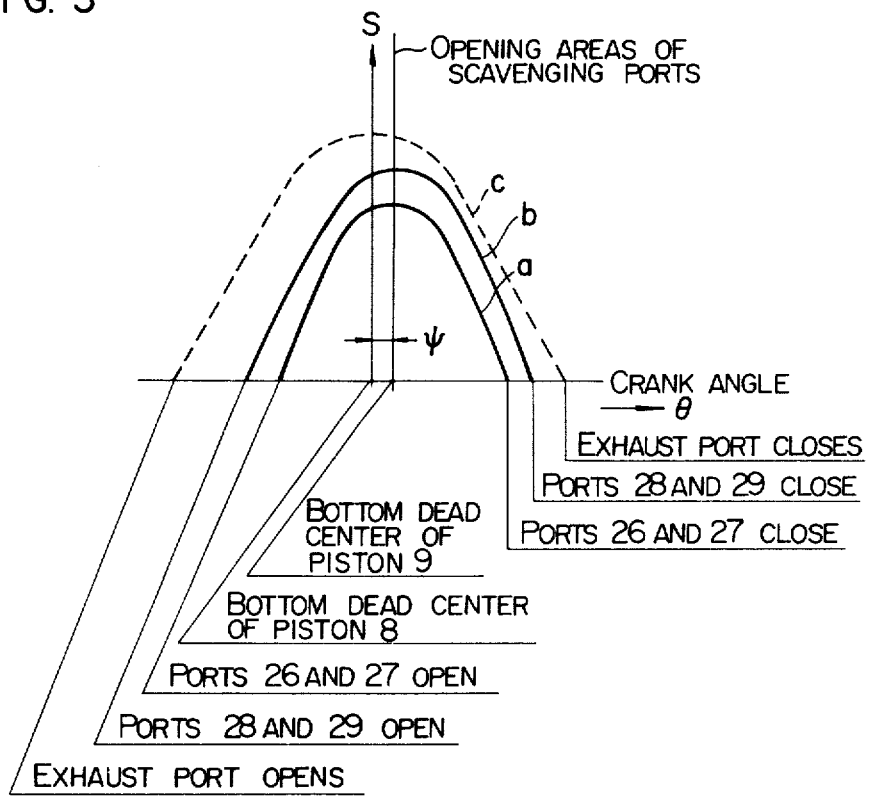
FIG. 3 shows the relationship between the opening areas of scavenging ports and the crank angle in both the first and second embodiments of the present invention.

First Embodiment, FIGS. 1, 2 and 3

Referring to FIGS. 1 and 2, an engine main body 1 has one cylinder block 2 and two crankcases 3 and 4. The cylinder block 2 has a cylinder 5 and the crankcases 3 and 4 define crank chambers 6 and 7, respectively.

Two pistons 8 and 9 each having a partially spherically recessed head are slidably fitted into the cylinder 5 so as to move toward and away from each other and are connected through connecting rods 10 and 11, respectively, to a crankshaft (not shown).

An ignition plug 12 is provided in the cylinder wall at the midpoint thereof, and an exhaust port 13 for discharging combustion gas from the cylinder 5 is also provided in the cylinder wall so as to be opened and closed by the piston 8.

A rich combustible mixture of air and gasoline is charged from a first carburetor 18 through an intake manifold 16 and a reed valve 14 at an intake port into the first crank chamber 6. In like manner, a lean combutible mixture of air and gasoline or air is charged from a second carburetor 19 through an intake manifold 17 and a reed valve 15 at an intake port into the second crank chamber 7. The first and second carburetors 18 and 19 are connected to separate air cleaners 20 and 21, respectively.

The cylinder 5 and the crank chamber 6 are communicated with each other through two scavenging passages 22 and 23 while the cylinder 5 and the crank chamber 7 are communicated with each other through two scavenging passages 24 and 25.

As shown in FIG. 2, one end on the side of the cylinder 5 of each of the scavenging passages 22, 23, 24 and 25 is branched into three scavenging ports 26, 27, 28 or 29 which are covered and uncovered by the piston 9.

A water jacket 30 is formed adjacent to the scavenging passages 22 and 23 intercommunicating between the first crank chamber 6 and the cylinder 5 so that the atomization of the rich air-fuel mixture may be facilitated by heat liberated from the cooling water. Alternatively, the scavenging passages 22 and 23 may be of course formed adajcent to the exhaust gas passages so that the rich combustible mixture or charge may be heated by the exhaust gases.

The scavenging ports 26 and 27 through which is drawn the rich mixture into the cylinder 5 are so arranged as to be directed toward the partially spherical recess in the head of the second piston 9 when the latter is at the bottom dead center (See FIG. 1), whereby the rich mixture may flow along the partially spherical surface of the head. The scavenging ports 28 and 29 through which is drawn the lean air-fuel mixture or air into the cylinder 5 are so directed that the lean mixture or air flows toward the center of the cylinder 5 and hence toward the ignition plug 12 and the exhaust port 13, when the piston 9 is at the bottom dead point.

FIG. 3 shows the relationship between the opening areas S of the scavenging ports 26, 27, 28 and 29 and the displacement of the piston or the crank angle $\theta$. That is, the curve a shows the opening area of the ports 26 and 27 while the curve b, the opening area of the ports 28 and 29. It can be seen that the scavenging ports are so located that the scavenging ports 28 and 29 are opened earlier than the scavenging ports 26 and 27.

From FIG. 3 it can be also seen that the first piston 8 is advanced in phase by $\phi$ over the second piston 9. In FIG. 3, the curve c shows the opening area of the exhaust port 13 depending upon the crank angle of the first piston 8.

Next the mode of operation of the first embodiment with the above construction will be described. As in the case of an ordinary two-cycle gasoline engine, the rich mixture and lean mixture or air are charged from the first and second carburetors 18 and 19 into the crank chambers 6 and 7, respectively, through the intake manifolds 16 and 17 and the reed valves 14 and 15.

In the scavenging stroke, the rich mixture and lean mixture or air in the crank chambers 6 and 7 are introduced into the cylinder 5 through the scavenging passages 22-25. Since the scavenging ports 28 and 29 are opened earlier than the scavenging ports 26 and 27 as described above, the lean mixture or air is first drawn into the cylinder 5 through the scavenging passages 24 and 25, whereby the remaining combustion products are exhausted through the exhaust port 13. Since the scavenging ports 28 and 29 are directed toward the center of the cylinder 5 as described above, the lean mixture or air is forced to flow toward the ignition plug 12 and the exhaust port 13, whereby the satisfactory scavenging of the remaining combustion products may be attained.

The scavenging ports 26 and 27 are uncovered and opened a predetermined time after the scavenging ports 28 and 29 have been uncovered and opened so that the rich mixture is charged into the cylinder 5 through the scavenging passages 22 and 23. Since the scavenging ports 26 and 27 are directed toward the partially spherical recess of the head of the second piston 9 as described above, the rich mixture forms a layer at the head of the second piston 9.

As described above, the lean mixture or air is charged first so as to scavenge the remaining combustion products out of the cylinder 5 and then the rich mixture is drawn. As a result, escaping of the air-fuel mixture through the exhaust port 13 may be almost avoided or prevented to a minimum. Furthermore the remaining combustion products may be satisfactorily expelled out of the cylinder 5 through the exhaust port 13.

When the first and second pistons 8 and 9 approaches the upper dead points, the air-fuel mixture which is compressed in the cylinder 5 by the first and second pistons 8 and 9 is ignited by the ignition plug 12 and burned almost completely.

The rich mixture drawn into the cylinder 5 has been well atomized and vaporized when it flows through the scavenging passages 22 and 23 by the heat of the cooling water circulating through the water jacket 30 so that the positive ignition and combustion may be ensured. Furthermore this makes it possible to reduce the fuel consumption of the engine, because even if somewhat lean mixture is charged into the cylinder 5 through the scavenging passages 22 and 23, good ignition of such mixture may be ensured.

Figure 4:
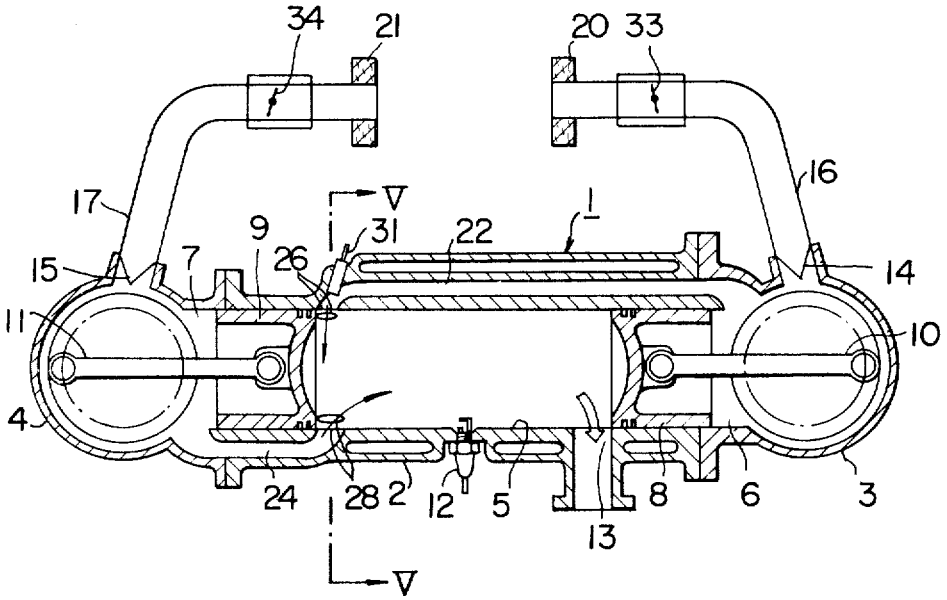
FIG. 4 is a longitudinal sectional view of a second embodiment of the present invention taken along the line IV—IV of FIG. 5.
Figure 5:
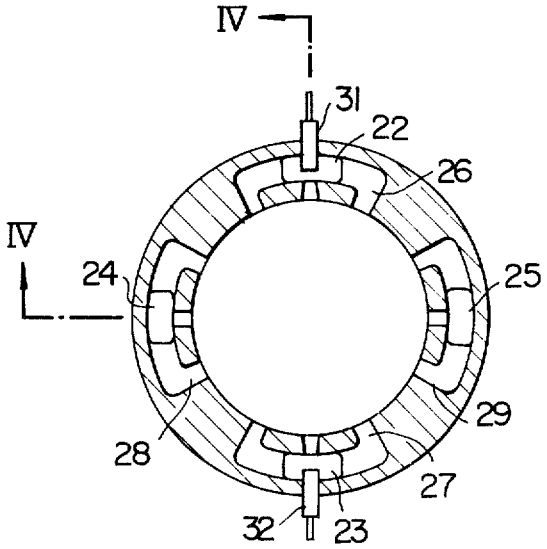
FIG. 5 is a sectional view taken along the line V—V of FIG. 4.

Second Embodiment, FIGS. 4 and 5

The second embodiment shown in FIGS. 4 and 5 is substantially similar in construction to the first embodiment shown in FIGS. 1 and 2 except that instead of the first and second carburetors 18 and 19, first and second throttle valve assemblies 33 and 34 are provided and connected to the intake manifolds 16 and 17 and the air cleaners 20 and 21 and that first and second fuel injection valves 31 and 32 are located in the cylinder block 2 in such a way that they may inject the fuel to the portions adjacent to the scavenging ports 26 and 27 of the scavenging passages 22 and 23. These fuel injection valves 31 and 32 are operatively coupled to a fuel injection pump or an electronically controlled fuel injection system (not shown). Instead of two fuel injection valves 31 and 32, only one fuel injection valve may be employed so as to inject the fuel either through the scavenging port 26 or 27.

Next the mode of operation of the second embodiment with the above construction will be described. Air is charged into the crank chambers 6 and 7 through the air cleaners 20 and 21, the throttle valve assemblies 33 and 34, the intake manifolds 16 and 17 and the reed valves 14 and 15. In the scavenging stroke the air charged into the crank chambers 6 and 7 is further charged into the scavenging passages 22–25. Since the scavenging ports 28 and 29 of the scavenging passages 24 and 25 are uncovered and opened earlier than the scavenging ports 26 and 27, the air in the scavenging passages 24 and 25 is first drawn into the cylinder 5 expelling the remaining combustion products through the exhaust port 13. Since the scavenging ports 28 and 29 are directed toward the center of the cylinder 5, the air is forced to flow toward the ignition plug 12 and the exhaust port 13 so that the satisfactory scavenging of the remaining combustion products may be ensured.

The fuel is injected through the first and second injection valves 31 and 32 into the scavenging passages 22 and 23 adjacent to their scavenging ports 26 and 27 so that the rich mixtures of air and fuel may be produced. As the scavenging ports 26 and 27 are uncovered and opened a predetermined time after the scavenging ports 28 and 29 have been uncovered and opened, the rich mixtures are charged through the scavenging ports 26 and 27 into the cylinder 5. Since the scavenging ports 26 and 27 are directed toward the partially spherical recess in the head of the second piston 9, the rich mixture layer is formed adjacent to the head of the second piston 9.

As described above, after the air has been charged into the cylinder 5 so as to expel the remaining combustion products out of the cylinder 5 through the exhaust port 13, the rich mixtures are charged into the cylinder 5. As a result, escaping of the air-fuel mixture through the exhaust port 13 may be almost avoided or prevented to a minimum. Furthermore satisfactory scavenging may be ensured.

What we claim is:

1. A uniflow, double-opposed piston type two-cycle internal combustion engine of the type comprising a cylinder having a center portion in which an ignition plug is provided;

a pair of crankcases securely attached to the ends of said cylinder so to define a first crank chamber and a second crank chamber;

a pair of cranks disposed in said first and second crank chambers;

first and second pistons operatively connected to said cranks, respectively, and slidably fitted into said cylinder so as to move toward and away from each other with said first piston leading said second piston, both of said first and second pistons including a head having a partially spherical recess;

an exhaust port being formed through the wall of said cylinder so as to be opened and closed by said first piston; and a plurality of scavenging ports being formed through the wall of said cylinder so as to be opened and closed by said second piston;

first means for feeding a rich air-fuel mixture into said cylinder through a predetermined number of said plurality of scavenging ports; and second means for feeding a relatively leaner air-fuel mixture into said cylinder through the remaining ones of said plurality of scavenging ports;

said first feeding means and said second feeding means being so arranged that said remaining scavenging ports are opened earlier than said predetermined number of said scavenging ports;

wherein said predetermined number of said scavenging ports are arranged so that the rich mixture is directed toward the top surface of the head of said second piston when the latter is at the bottom dead center; and said remaining scavenging ports are arranged so that the relatively leaner mixture is directed toward the center portion of said cylinder when said second piston is at the bottom dead center.

2. A uniflow, double-opposed piston type two-cycle internal combustion engine as set forth in claim 1, wherein said first feeding means has means for charging the rich mixture into said first crank chamber, and rich mixture scavenging passages intercommunicating between said first crank chamber and said predetermined number of said scavenging ports; and wherein said second feeding means has means for charging the relatively leaner mixture into said second crank chamber; and leaner mixture scavenging passages intercommunicating between said second crank chamber and said remaining scavenging ports;

said pair of cranks including a first crank and a second crank disposed in said first and second crank chambers, respectively; and said first and second pistons operatively connected to the first and second cranks, respectively.

3. A uniflow, double-opposed piston type two-cycle internal combustion engine as set forth in claim 1, wherein said first feeding means has means for charging air into said first crank chamber;

scavenging passages intercommunicating between said first crank chamber and said predetermined number of scavenging ports; and fuel injection means for injecting the fuel into said scavenging passages adjacent to said predetermined number of scavenging ports; and said second feeding means has means for charging air into said second crank chamber; and scavenging passages intercommunicating between said second crank chamber and said remaining scavenging ports.

* * * * *